US006868624B1

(12) United States Patent
Trinkaus

(10) Patent No.: US 6,868,624 B1
(45) Date of Patent: Mar. 22, 2005

(54) SPORTS SHOE, ESPECIALLY SKI SHOE

(75) Inventor: Gerhard Trinkaus, Voitsberg (AT)

(73) Assignee: Atomic Austria GmbH, Altenmarkt im Pongau (AT)

( * ) Notice: Subject to any disclaimer, the term of this patent is extended or adjusted under 35 U.S.C. 154(b) by 216 days.

(21) Appl. No.: 10/130,558

(22) PCT Filed: Nov. 14, 2000

(86) PCT No.: PCT/AT00/00299

§ 371 (c)(1),
(2), (4) Date: Sep. 10, 2002

(87) PCT Pub. No.: WO01/35779

PCT Pub. Date: May 25, 2001

(30) Foreign Application Priority Data

Nov. 17, 1999 (AT) ..... 1936/99

(51) Int. Cl.[7] ..... A43B 5/00
(52) U.S. Cl. ..... 36/117.1; 36/117.3; 36/25 R
(58) Field of Search ..... 36/117.1, 117.3, 36/25 R, 30 R

(56) References Cited

U.S. PATENT DOCUMENTS 3,125,816 A * 3/1964 Gartner ..... 36/117.3
3,834,046 A 9/1974 Fowler
4,571,858 A * 2/1986 Faulin ..... 36/117.4
5,243,773 A * 9/1993 Robic ..... 36/117.3
5,400,527 A * 3/1995 Marega et al. ..... 36/117.3
6,065,228 A * 5/2000 Begey et al. ..... 36/15
6,588,125 B2 * 7/2003 Proctor, Sr. ..... 36/117.1

FOREIGN PATENT DOCUMENTS

| | | |
|---|---|---|
| AT | 001700 | 10/1997 |
| CH | 572717 | 2/1976 |
| CH | 660946 | 6/1987 |
| CH | 677587 | * 6/1991 |
| EP | 0672365 | 9/1995 |
| FR | 2265294 | 10/1975 |
| FR | 2492236 | 4/1982 |
| FR | 2732197 | 10/1996 |
| WO | WO92/03069 | 3/1992 |

* cited by examiner

*Primary Examiner*—M. D. Patterson
(74) *Attorney, Agent, or Firm*—Collard & Roe, P.C.

(57) ABSTRACT

The invention relates to a sports shoe (1), in particular a ski boot (2), having a shell part (3) made from plastics. A shell base (11) of the shell part (3) forming support surface (12) an inner shoe (10) or foot (9) is provided in the form of an impact- and/or vibration-damping ribbed fitting, consisting of a shell wall and a ribbed lattice formed on a surface thereof remote from the support surface (12). Certain regions of this ribbed fitting are enclosed by a bending- and/or torsion-resistant profiled element (43) extending in a longitudinal direction substantially between a heel- and a ball-bearing region (32, 33) and secured between block elements (29) and the ribbed fitting by means of clamping and fixing means.

23 Claims, 3 Drawing Sheets

SPORTS SHOE, ESPECIALLY SKI SHOE

CROSS REFERENCE TO RELATED APPLICATIONS

Applicants claim priority under 35 U.S.C. §119 of Austrian Application No. A1936/99 filed Nov. 17, 1999. Applicants also claim priority under 35 U.S.C. §1 365 of PCT/AT00/00299 filed Nov. 14, 2000. The international application under PCT article 21(2) was not published in English.

The invention relates to a sports shoe of the type outlined in the generic part of claim 1.

A ski boot is known from patent specification EP 0 672 365 A2, comprising a sole part consisting of at least a heel and a pointed part attached to a shell, which is provided with a longitudinal stiffening member attached to the underside of the shell as a means of increasing torsional strength to produce an exact and effective transmission of force. Due to the fact that the force of the changing loads acting on the longitudinal stiffening member during travel is transmitted over a broad surface area directly in the region of the shell which forms the support surface for the foot, parasitic vibrations occur which lead to premature tiredness and hence unsafe travel.

The objective of the invention is to propose a sports shoe, in particular a ski boot, which has a high torsional strength and good damping properties to prevent undesirable vibrations, yet saves on material and weight.

This objective is achieved by the invention due to the features defined in the characterising part of claim 1. The surprising advantage of an integrally formed ribbed fitting, comprising shell wall and ribs with a profiled element supporting it, is that impact and vibration loads are damped and thus kept away from the foot of the user, whilst the resultant bending-resistant join imparts a high degree of sensitivity, as a result of which the steering forces applied by the foot of the user via the shoe to a running device are transmitted uniformly across the blocks disposed in the toe and heel regions of the sports shoe. Furthermore, it has been found that this design does not impair the intrinsic mechanical and dynamic properties of a running device, in particular a ski, such as flexibility and bending behaviour, and using a sports shoe as proposed by the invention in effect plays a significant role in improving these specific properties.

Embodiments as described in claims 2 and 3 are also of advantage, since they produce perfect traction between the co-operating components whilst providing longitudinal compensation between the support contour and the ribbed fitting, imparting a certain degree of bending elasticity to the sports shoe.

The advantageous embodiment described in claim 4 ensures rapid and error-free assembly of the co-operating components, preventing any unacceptable variances which might otherwise impair function.

As a result of the advantageous embodiments described in claims 5 and 6, bending deformation in the longitudinal extension of the sports shoe is permitted within an exactly predeterminable degree, which therefore improves travel comfort.

Another possible embodiment defined in claim 7 provides side coverage for hollow regions of the rib fitting and lateral support for the shell base.

As a result of the-advantageous embodiments defined in claims 8 and 9, the individual elements are positioned relative to one another to permit longitudinal compensation in the longitudinal direction whilst simultaneously affording transverse stability for a vibration-free transmission of transverse forces.

The embodiments defined in claims 10 to 12 are of advantage because they meet the dimensional requirements for an injection moulding process on the one hand and provide the degree of strength required of sports shoes of this type to withstand the loads placed on them whilst offering maximum damping properties.

Claims 13 to 15 also describe advantageous embodiments which provide the torsional strength needed to support the shell part.

Extra fixing means can be dispensed with as a result of the advantageous embodiment described in claim 16.

With an advantageous embodiment such as that defined in claim 17, a tight fit is obtained between shell base and block elements, effectively preventing ingress by foreign bodies.

Other advantageous features are described in claims 18 and 19 which ensure a long useful life without any significant wear, making the sports shoe reliable for its application.

Another possible embodiment is described in claim 20, which provides additional damping properties.

Finally, the features defined in claims 21 to 23 are of advantage because they increase the strength properties of the profiled element so that it can be designed to take the highest of loads.

To provide a clearer understanding, the invention will be described in more detail below with reference to embodiments illustrated in the appended drawings.

Of these:

Figure 1:
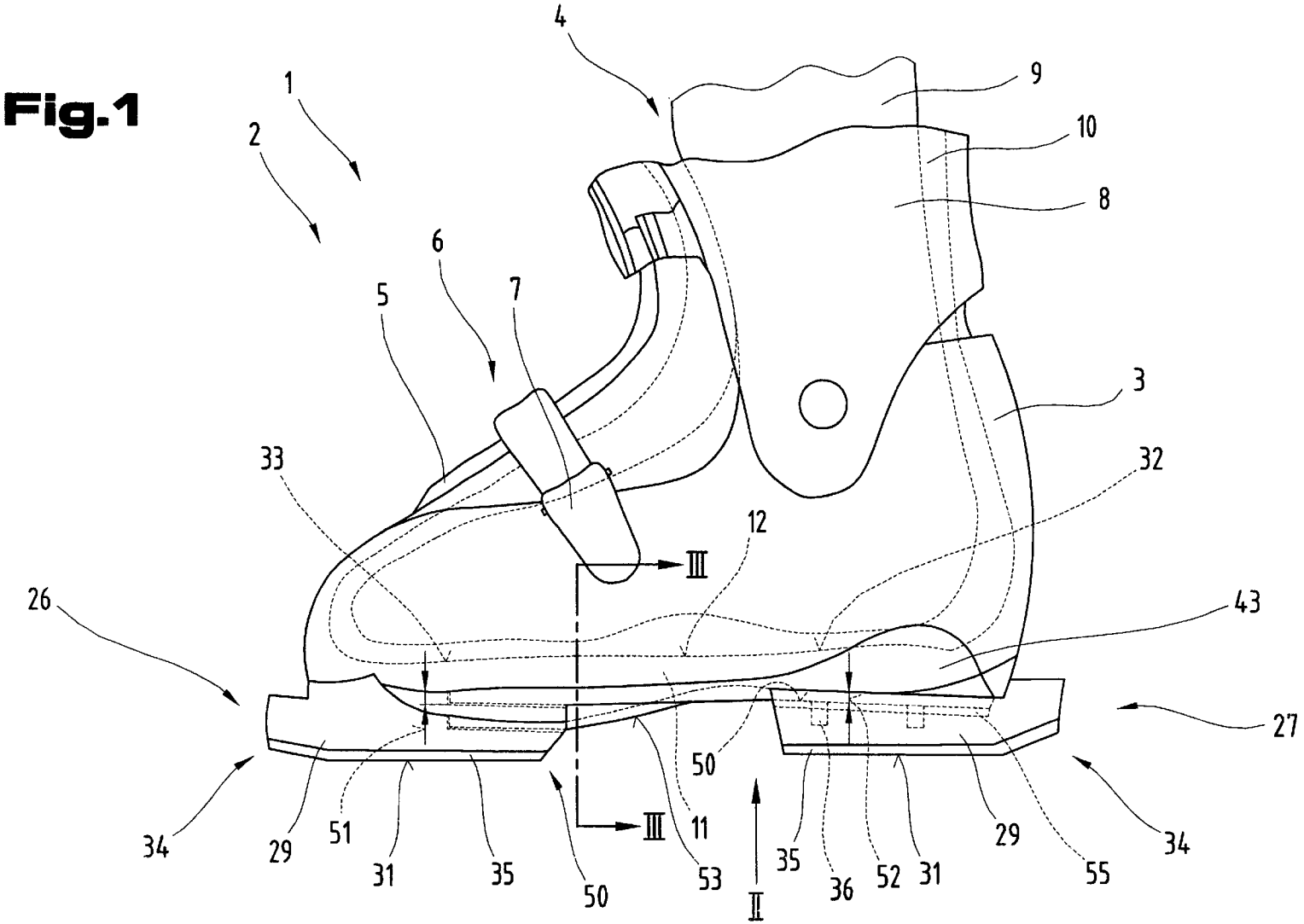
FIG. 1 depicts a view of the sports shoe proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
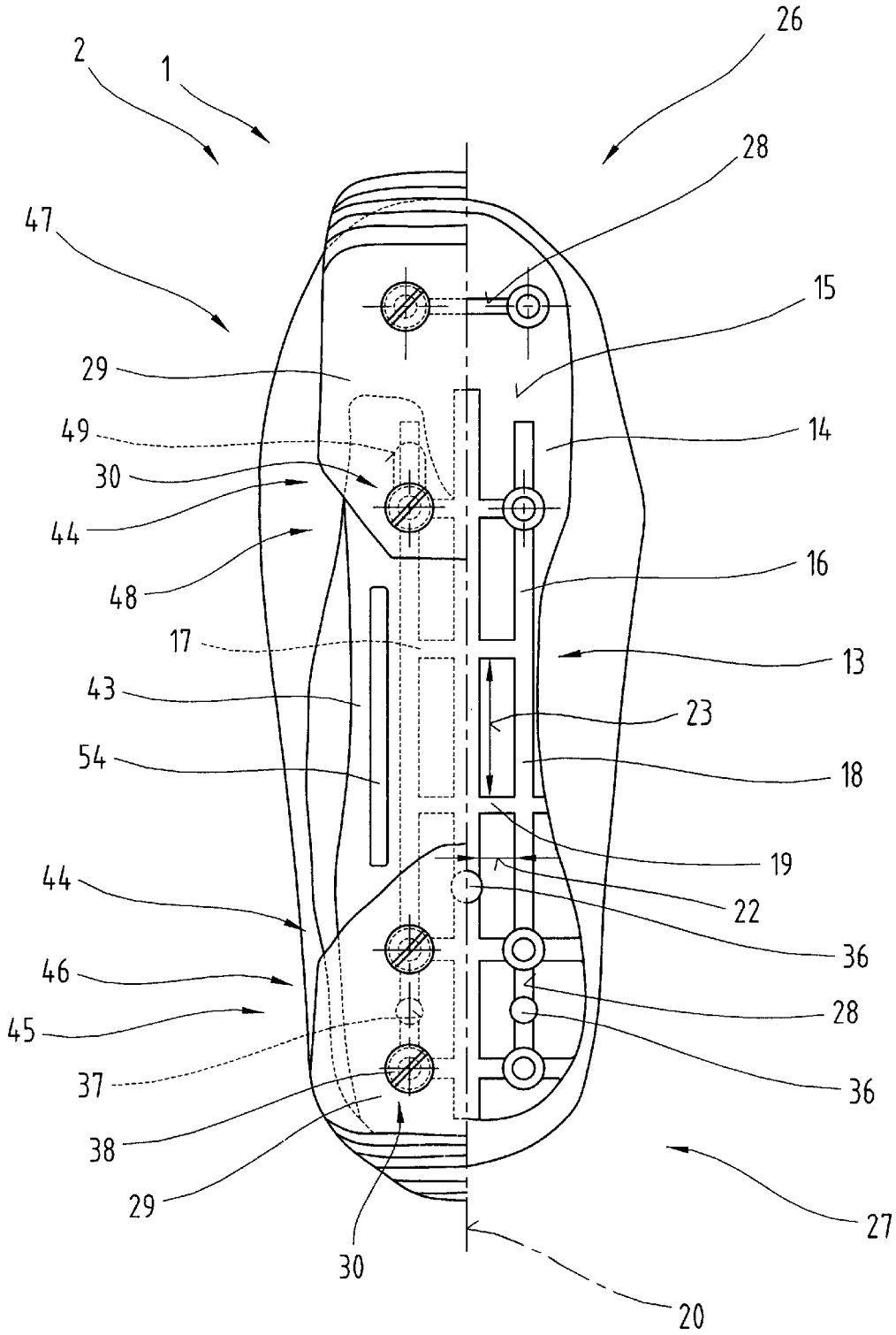
FIG. 2 illustrates the same sports shoe seen in partial section along II indicated in FIG. 1.
Figure 3:
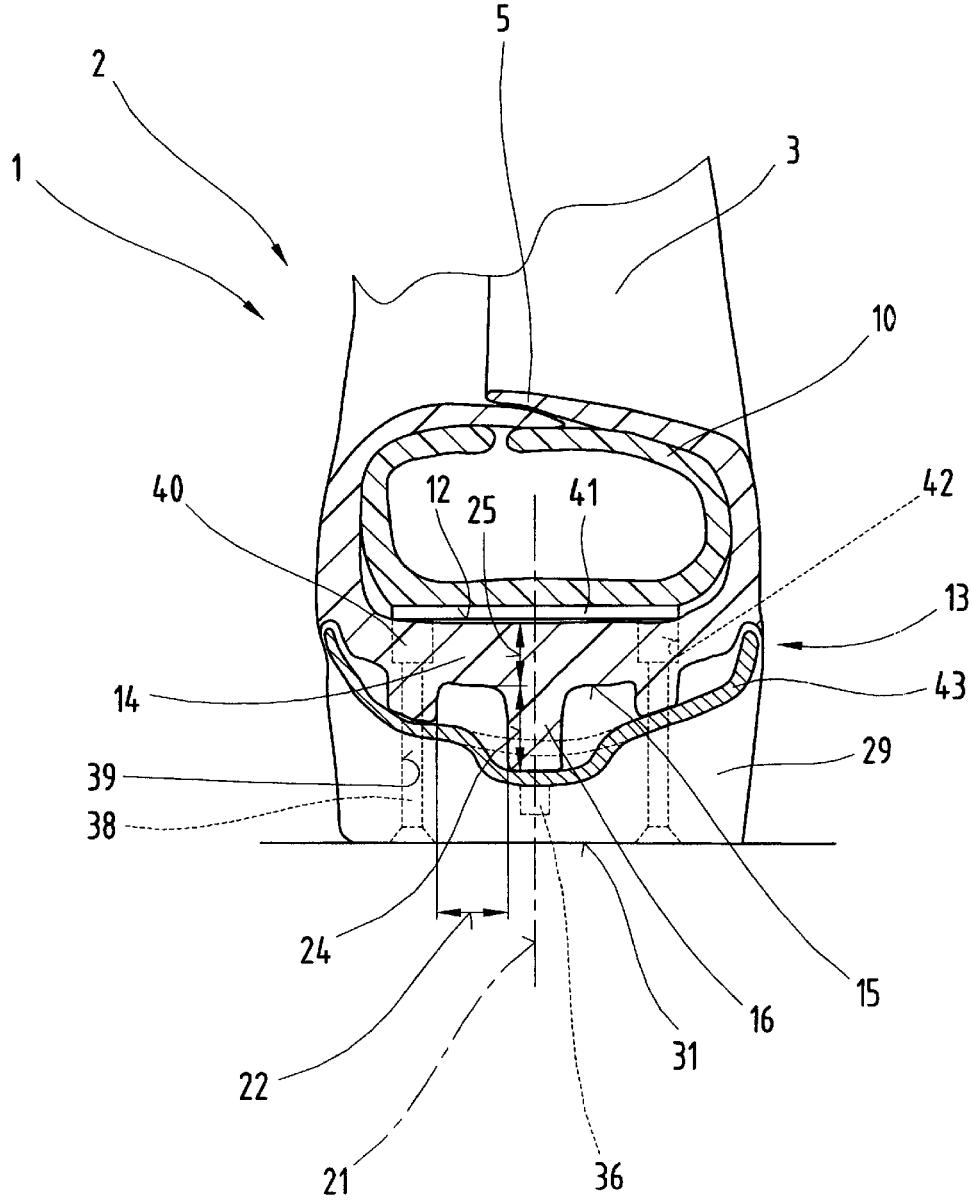
FIG. 3 is a view of the sports shoe in section along the lines III—III ml indicated in FIG. 1.

FIGS. 1 to 3 illustrate a sports shoe 1, in particular a ski boot 2. The ski boot 2 consists of a shell part 3, made in particular by a plastics injection moulding process, manufactured using different plastics materials in certain regions by plastics-injection technologies known from the prior art, to impart the best respective material properties to the different regions of a shoe.

The shell part 3 is provided with an insertion orifice 4, which in a so-called overlap shoe of this type is closed by flaps 5 formed on the shell part 3 and appropriate closure elements 6, e.g. clasps 7. A pivotable cuff part 8 is also pivotably mounted on the shell part 3. To accommodate a foot 9, an inner shoe 10 is provided, incorporating the shell part 3 and cuff part 8.

A shell base 11, with a support surface 12 for the foot 9 or inner shoe, is provided in the form of an impact- and/or vibration-damping ribbed fitting 13. This ribbed fitting 13 is formed by a shell wall 14 and, formed on the surface 15 thereof remote from the support surface 12, ribs 16. The latter cover the surface 15 in the form of a ribbed lattice 17 made up of longitudinal ribs 18 with transverse ribs 19 extending substantially perpendicular thereto.

In the specific embodiment described as an example here, one of the longitudinal ribs 18 extends in a longitudinal mid-plane 21 constituting the longitudinal mid-axis 20, with another on each side at a distance 22 from the longitudinal mid-plane 21. These longitudinal ribs 18 are joined by means of the transverse ribs 19 to form the ribbed lattice 17, a distance 23 between the transverse ribs being greater than the distance 22 between the longitudinal ribs 18. A! rib height 24 corresponds more or less to a thickness 25 of the shell wall 14, but the longitudinal rib 18 extending along the longitudinal mid-plane 21 increases in height towards a front end region 26 of the sports shoe 1. The ribs 16 and the way they are arranged on the surface 15 are specifically intended to impart an excellent impact- and/or vibration-damping design to the ribbed fitting 13.

In the front end region 26 and a rear end region 27, the ribbed fitting 13 provide mounting surfaces 28 for block elements 29, which are fixed to the ribbed fitting 13 by clamping and fixing means 30 and form standing surfaces 31. Projecting above the shell part 3, the block elements 29 are essentially provided in a heel-bearing region 32 and a front ball-bearing region 33 and, in conjunction with projections standing proud of the shell part 3, form coupling projections 34, for a ski binding, a board binding or similar retaining mechanisms, for example. The standing surfaces 31 of the block elements 29 are generally of an anti-slip design and may optionally be provided with a wear-resistant coating 35. To adjust the block elements 29 to the correct position on the ribbed fitting 13, positioning pins 36 are provided in the ribbed fitting 13, which co-operate with pin bores 37 provided in the block elements 29.

The clamping and fixing means 30 are screw connections 38, the block elements 29 receiving threaded screws in bores, e.g. countersunk screws 39, which extend from the standing surface 31 through the block elements 29 and are screwed into threaded bushes 40 anchored in the shell part 3. In the embodiment illustrated as an example here, the threaded bushes 40 are permanently joined to an anchoring plate 41, which sits on the support surface 12 of the shell base 11, the threaded bushes 40 projecting through recesses 42 of the ribbed fitting 13. The block elements 29 are therefore absolutely securely fastened to the ribbed fitting 13 and will reliably absorb reaction forces acting via fixing means on the sports shoe 1.

To provide a bending- and/or torsion resistant support for the shell base 11, the ribbed fitting 13 is provided with a profiled element 43, made from fibre-reinforced plastics for example, by which it is enclosed in certain regions in a shell-like arrangement and to which it is joined to prevent displacement. This profiled element 43 extends between the clamping and fixing means 30 between the ribbed fitting 13 and the block elements 29 and in these regions is also joined to the block elements 29 on the ribbed fitting 13. Accordingly, end regions of the profiled elements 43 and the block elements 29 form overlap regions 44. The profiled element 43 is shaped and adapted to conform to the three-dimensional design of the underside of the ribbed fitting 13, imparting very high torsional strength. To impart a certain degree of bending elasticity to the sports shoe 1, on the other hand, which requires a means of enabling longitudinal compensation between the ribbed fitting 13 and the profiled element 43, a connecting region 45 is provided in the overlap region 44 in the form of a fixed bearing 46, for example, whilst another connecting region 47 is designed as a loose baring 48, in which longitudinal compensation can be provided between profiled element 43 and ribbed fitting 13 or block element 29, and for this purpose elongate holes 49 are provided in the profiled element 43 in the region of the screw connections 38, and block element 29 and ribbed fitting 13 are spaced at a distance apart from one another by a seating 50 provided in the block element 29 which is slightly larger than a thickness 52 of the profiled element 43. This design on the one hand allows torsional forces to be perfectly absorbed and dispersed but on the other hand permits longitudinal compensation by means of intrinsic bending deformations.

Clearly, apart from fibre-reinforced plastics material, there is a whole range of other materials which might be used for the profiled element 43, e.g. titanium/titanium-aluminium, carbon, sheet stainless steel, etc. The basic requirement for the material is that it should be very strong and low in weight and be highly resistant to atmospheric influences such as fold, moisture, salt, etc. Another way of varying the strength of the profiled element 43 is to provide stiffening webs 54 on a surface 53 extending between the block elements 29.

For additional vibration damping, another possibility is to place damping inserts 55, made from elastomers for example, between the block elements 29 and the profiled element 43 or the ribbed fitting 13. These may be separate inserts or may be formed on the block elements 29 facing the ribbed fitting 13.

For the sake of good order, it should be pointed out that to provide a clear understanding of the structure of the sports shoe 1, it and its constituent parts are illustrated to a certain extent out of proportion and/or on a larger or smaller scale.

The tasks underlying the independent solutions proposed by the invention may be found in the description.

Above all, the individual embodiments illustrating the subject matter of the invention in FIGS. 1, 2, 3 may be construed as independent solutions proposed by the invention. The tasks and solutions may be found in the detailed descriptions of these drawings.

LIST OF REFERENCE NUMBERS

| | | | |
|---|---|---|---|
| 1 | Sports shoe | 31 | Standing surface |
| 2 | Ski boot | 32 | Heel-bearing region |
| 3 | Shell part | 33 | Ball-bearing region |
| 4 | Insertion opening | 34 | Coupling projection |
| 5 | Flap | 35 | Coating |
| 6 | Closure element | 36 | Positioning pin |
| 7 | Buckle | 37 | Pin bore |
| 8 | Cuff part | 38 | Screw connection |
| 9 | Foot | 39 | Countersunk screw |
| 10 | Inner shoe | 40 | Threaded bush |
| 11 | Shell base | 41 | Anchoring plate |
| 12 | Support surface | 42 | Recess |
| 13 | Ribbed fitting | 43 | Profiled element |
| 14 | Shell wall | 44 | Overlap region |
| 15 | Surface | 45 | Connecting region |
| 16 | Ribs | 46 | Fixed bearing |
| 17 | Ribbed lattice | 47 | Connecting region |
| 18 | Longitudinal ribs | 48 | Loose bearing |
| 19 | Transverse rib | 49 | Elongate holes |
| 20 | Longitudinal mid-axis | 50 | Seating |

-continued

| | | | |
|---|---|---|---|
| 21 | Longitudinal mid-plane | 51 | Distance |
| 22 | Distance | 52 | Thickness |
| 23 | Distance | 53 | Surface |
| 24 | Rib height | 54 | Stiffening web |
| 25 | Thickness | 55 | Damping insert |
| 26 | End region | | |
| 27 | End region | | |
| 28 | Mounting surface | | |
| 29 | Block element | | |
| 30 | Clamping and fastening means | | |

What is claimed is:

1. Sports shoe, comprising a shell part made from a plastics material with a cuff pivotably attached to the shell and at least one sole part attached to the shell part, wherein a shell base of the shell part forming a support surface for an inner shoe or foot is provided in the form of an impact- and vibration-damping ribbed fitting consisting of a shell wall and, disposed thereon on a surface remote from the support surface, a ribbed lattice, regions of which are enclosed by a profiled element extending in the longitudinal direction substantially between a heel- and ball-bearing region and fixed between block elements and the ribbed fitting by means of clamping and fixing means.

2. Sports shoe as claimed in claim 1, wherein the block elements overlap with the profiled element at opposite overlap regions, the profiled element being retained in one of the overlap regions so as to be non-displaceable in the longitudinal direction and being longitudinally displaceable between the block elements and the ribbed fitting in the other overlap region.

3. Sports shoe as claimed in claim 1, wherein the block elements have recesses for the profiled element in the clamping surfaces directed towards the ribbed fitting.

4. Sports shoe as claimed in claim 1, wherein positioning pins are d in the ribbed fitting and project beyond it in order to position the profiled element and the block elements.

5. Sports shoe as claimed in claim 1, wherein the profiled element is fixed in the longitudinal direction between the block element and shell base in the heel-bearing region.

6. Sports shoe as claimed in claim 1, wherein the profiled element is retained so as to be longitudinally displaceable between the block element and shell base in the ball-bearing region.

7. Sports shoe as claimed in claim 1, wherein the profiled element laterally encloses certain regions of the shell base in a substantially U-shaped arrangement.

8. Sports shoe as claimed in claim 4, wherein positioning recesses in the profiled element and in the block elements are provided for the positioning pins.

9. Sports shoe as claimed in claim 8, wherein the positioning recesses in the profiled element are elongate holes extending in the longitudinal direction.

10. Sports shoe as claimed in claim 1, wherein the ribbed lattice of the ribbed fitting consists of longitudinal ribs extending in the longitudinal direction and transverse ribs extending perpendicularly thereto.

11. Sports shoe as claimed in claim 1, wherein a distance between adjacent longitudinal ribs is smaller than a distance between transverse ribs extending perpendicularly thereto.

12. Sports shoe as claimed in claim 1, wherein a rib height substantially corresponds to a thickness of the shell wall.

13. Sports shoe as claimed in claim 1, wherein a thickness of the profiled element is approximately 0.5 mm to 2.0 mm.

14. Sports shoe as claimed in claim 1, wherein the profiled element is made from high-strength plastics, a metal alloy, carbon, or sheet steel.

15. Sports shoe as claimed in claim 14, wherein the profiled element is made from titanium-aluminum.

16. Sports shoe as claimed in claim 1, wherein the block elements are fixed to the shell base with the profiled element inserted in between.

17. Sports shoe as claimed in claim 1, wherein positioning recesses are provided on the shell base for the block elements.

18. Sports shoe as claimed in claim 1, wherein the block elements are made from wear-resistant plastics.

19. Sports shoe as claimed in claim 1, wherein the block elements are provided with an anti-slip coating.

20. Sports shoe as claimed in claim 1, wherein damping inserts made from impact- and vibration-damping materials are provided between the block elements and the profiled element and/or the shell base.

21. Sports shoe as claimed in claim 1, wherein the profiled element has stiffening webs on the surface remote from the shell base.

22. Sports shoe as claimed in claim 1, wherein stiffening webs are arranged on the profiled element in the form of a web lattice.

23. Sports shoe as claimed in claim 22, wherein a height of the stiffening webs substantially corresponds to the thickness of the profiled element.

* * * * *